United States Patent [19]

Birkholz et al.

[11] Patent Number: 4,840,249

[45] Date of Patent: Jun. 20, 1989

[54] APPARATUS FOR SREWING A COVER ONTO A SCREW NECK OF A HEARING AID

[75] Inventors: Ulrich Birkholz, Bayreuth; Christof Haertl, Neunkirchen; Peter Nassler, Eckental, all of Fed. Rep. of Germany

[73] Assignee: Siemens Aktiengesellschaft, Berlin and Munich, Fed. Rep. of Germany

[21] Appl. No.: 45,448

[22] Filed: May 1, 1987

[30] Foreign Application Priority Data

May 16, 1986 [DE] Fed. Rep. of Germany ..... 3616637

[51] Int. Cl.[4] ..... H04R 25/02

[52] U.S. Cl. ..... 181/129; 181/130; 181/135; 381/68.6; 81/176.1

[58] Field of Search ..... 181/129, 130, 135, 175; 381/68.6, 69; 81/52, 176.1, 176.15, 176.2, 436, 444, 461

[56] References Cited

U.S. PATENT DOCUMENTS

| | | | |
|---|---|---|---|
| 3,140,625 | 2/1964 | Pannozzo | 81/176.15 X |
| 3,157,245 | 11/1964 | Bernstein | 181/135 |
| 3,170,046 | 2/1965 | Leale | 381/68.6 |
| 4,164,967 | 8/1979 | Breuers | 81/461 |
| 4,686,874 | 8/1987 | McCauley et al. | 81/461 |

FOREIGN PATENT DOCUMENTS

| | | |
|---|---|---|
| 2949992 | 7/1980 | Fed. Rep. of Germany . |
| 3228166 | 2/1986 | Fed. Rep. of Germany . |

*Primary Examiner*—B. R. Fuller

[57] ABSTRACT

A rotary shaft is provided with at least two pins at its one end, these two pins fitting into two holes of the cover. The other end of the rotary shaft carries a polygonal screw pin for screwing on the adaptor.

8 Claims, 1 Drawing Sheet

APPARATUS FOR SREWING A COVER ONTO A SCREW NECK OF A HEARING AID

BACKGROUND OF THE INVENTION

1. Field of the Invention

The invention is directed to an apparatus for screwing a cover onto a screw neck of a hearing aid.

An in-the-ear hearing aid module is disclosed in our German utility model application No. 85 18 681.3 (pending U.S. application Ser. No. 875,929) which is insertable into the cavity of a otoplastic shell, being insertable such that a proximal screwneck projects from a proximal opening of the otoplastic. A cover can be screwed onto the screwneck. The in-the-ear hearing aid module can thereby be fixed in the otoplastic shell. The cover also includes sieve-like openings. It thus simultaneously serves as a cerumen trap. It is in this type of construction that the present invention would be useful.

2. Description of the Prior Art

In the case of in-the-ear hearing aids, the screwneck and the cover have extremely small dimensions. They thus require a special screw-on aid or tool for the cover whose dimensions are correspondingly small but which nonetheless supplies the required torques for the cover without risk of breakage. This type of tool is not presently available.

SUMMARY OF THE INVENTION

An object of the invention is to provide such an apparatus.

This object is inventively achieved by an apparatus comprising a rotary shaft having a first end which has at least two pins lying essentially diametrically opposite one another relative to a longitudinal axis of the shaft, the pins mating with corresponding holes arranged in the cover lying essentially diametrically opposite one another with reference to the center axis of the cover. The first end of the shaft includes a recess having a floor from which the pins project beyond forward edges of the recess. The pins preferably are thicker where they join the floor of the recess than at their ends which project from the recess. It is also preferable to form the rotary shaft as a polygonal shaft to provide a better gripping surface. A second end of the shaft has a polygonal screw pin formed thereon for screwing an adaptor for an ear button to the screw neck of the hearing aid instead of the cover.

BRIEF DESCRIPTION OF THE DRAWINGS

Further advantages and details of the invention derive from the following description of an exemplary embodiment with reference to the drawing.

DESCRIPTION OF THE PREFERRED EMBODIMENTS

Figures 1, 2, 3, 4, 5, 6:
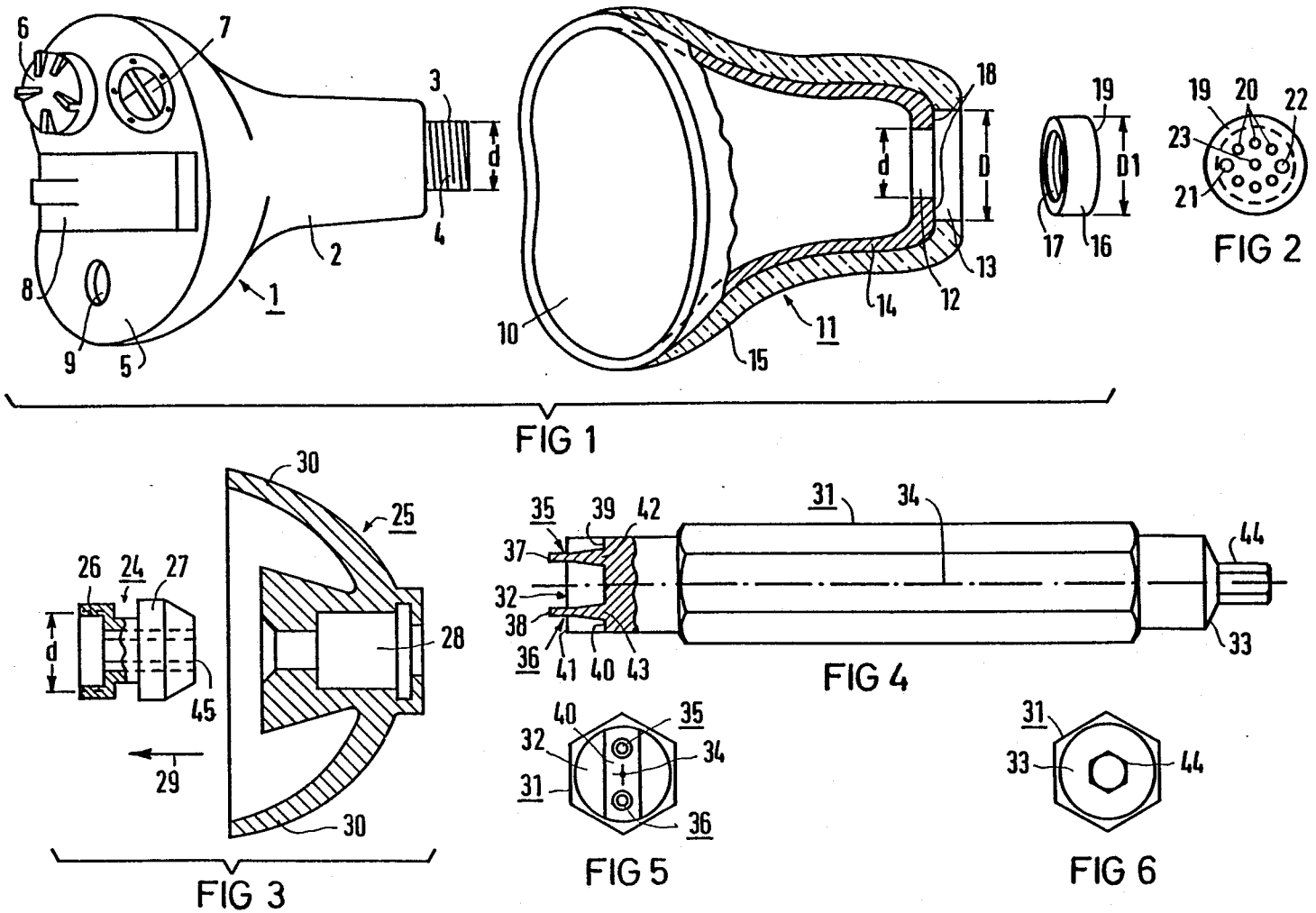
FIG. 1 is an in-the-ear hearing aid module together with a finished otoplastic shell and a cerumen cover which can be screwed onto a threaded neck of the module, shown in an exploded view.
FIG. 2 is a plan view of the cerumen cover of FIG. 1.
FIG. 3 is an adaptor screwable to the sound exit of the in-the-ear hearing aid module, an ear button for testing the module being in turn connectable to this adaptor shown in an exploded view.
FIG. 4 is a side elevational view of a tool having the shape of a rotary shaft for screwing the cerumen cover of FIGS. 1 and 2 or an adaptor of FIG. 3 to the threaded neck of the in-the-ear hearing air module, shown partially in section.
FIGS. 5 and 6 are elevational views of the two ends of the tool of FIG. 4.

FIG. 1 shows an in-the-ear hearing aid module 1 including a housing 2 which has a neck 3 with an outside thread 4 at its proximal end and a diameter d. The hearing aid module 1 has an adjustment knob 6 at its end face for a volume control which also serves as an on and off switch, a further adjustment element 7, a compartment 8 for a battery, and an opening 9 for the sound supply or feed.

The hearing aid module 1 can be inserted such into the hollow interior of an otoplastic shell 11 that the neck 3 projects through a first opening 12 into a second opening 13 of the otoplastic shell. The otoplastic shell 11 surrounds an outer shell 14 (for example of transparent acrylic) on which the actual otoplastic material 15 (for example, likewise transparent acrylic) is seated. A diameter of the first opening 12 is the same dimension as the diameter d of the neck 3 or is at most slightly greater, so that the neck is seated tightly in the first opening 12. A diameter D of the second opening 13 is larger than the diameter of the first opening.

A cerumen cover 16 having an inside thread 17 can be screwed onto the part of the neck 3 projecting into the second opening 13. A diameter D1 of the cerumen cover is somewhat smaller (preferably 0.2 mm smaller) than the diameter D of the second opening 13. The cerumen cover can thus be comfortably screwed into the opening 13 to such degree until it stops against an annular edge 18 of the cover shell 14. The in-the-ear hearing aid module 1 is thus seated firmly and acoustically tight in the finished otoplastic shell 11.

In accord with FIG. 2, the cerumen cover 16 includes sieve-like openings 20 at its end face 19. Accordingly, it simultaneously serves as a cerumen trap. Further, the cerumen cover 16 also includes two through holes 21 and 22 which are essentially arranged diametrically opposite one another with reference to the center axis 23 of the cover.

In accord with FIG. 3, an adaptor 24 and an ear button 25 pluggable thereto can serve to test an in-the-ear hearing aid module 1 of FIG. 1 with or without over shell 15. At its distal end, the adaptor 24 has an inside thread 26 having the diameter D. The adaptor can thus be screwed onto the outside thread 4 of the neck 3 of the in-the-ear hearing aid module 1 with this inside thread 26. A proximal plunger 27 of the adaptor can be buttoned into a hollow interior 28 of the ear button 25 when the ear button 25 is plugged onto the adaptor 24 in the direction of arrow 29. After plugging to the ear, a sealing bead 30 of the ear button 25 tightly seals the ear channel toward the outside.

A rotary shaft 31 of FIG. 4 is fashioned as a hexagonal shaft except for short regions at a first shaft end 32 and at a second shaft end 33. It can thus be positively turned between the index finger and thumb.

As shown in FIG. 4, the first end 32 of the rotary shaft 31 includes two pins 35 and 36 lying essentially diametrically opposite one another with reference to a longitudinal axis 34 of the rotary shaft, tips 37 and 38 of these pins 35 and 36 fitting well into the holes 21 and 22 of the cerumen cover 16 in terms of diameter. The pins 35 and 36 project from a floor 39 of a cross-channel 40, projecting beyond edges 41 of the cross-channel.

At their ends 42, 43 facing the floor 39 of the cross-channel 40, moreover, the pins 35 and 36 are thicker than at their tips 37, 38 projecting out of the cross-channel. This lends the pins greater stability when generating torques.

The rotary shaft 31, finally also includes a hexagonal screw pin 44 at its second end 33 which fits into a hexagonal opening 45 of the adaptor 24 of FIG. 3. With the assistance of this screw pin 44, thus, the adaptor 24 can be screwed onto the thread 4 of the neck 3 when desired.

The pins 35 and 36 are provided for screwing the cerumen cover 16 onto the outside thread 4 of the neck 3. To that end, the two pins 35 and 36 have their tips 37 and 38 inserted into the holes 21 and 22 of the cerumen cover 16. Subsequently, the cerumen cover 16 can be turned by turning the rotary shaft 21 for the purpose of screwing on the cover 16.

The rotary shaft 31 of FIG. 4, thus, forms an ideal multi-purpose tool for optionally screwing on a cerumen cover or an adaptor. The dimensions of the tool are extremely small in accord with the extremely small dimensions of the screw parts. However, due to the specific design, they are nonetheless so stable that the required torques can be offered without risk or breakage.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as out invention:

1. An apparatus for screwing a cover having a central axis onto a screw neck of a hearing aid, comprising a manually graspable rotary shaft having a first end which has at least two pins lying essentially diametrically opposite one another relative to a longitudinal axis of said rotary shaft, said pins mating with corresponding holes arranged in the cover lying essentially diametrically opposite one another with reference to the center axis of the cover.

2. An apparatus according to claim 1, wherein at said first end the rotary shaft includes a recess having a floor from which the pins project beyond forward edges of said recess.

3. An apparatus according to claim 2, wherein the pins are thicker at exposed ends thereof facing the floor of the recess than at opposed ends projecting from said recess.

4. An apparatus according to claim 1, wherein the rotary shaft is a polygonal shaft.

5. An apparatus according to claim 1, wherein the rotary shaft can be utilized to screw a cover onto a screw neck projecting from an opening of an otoplastic shell, this screw neck belonging to an in-the-ear hearing aid module inserted into a cavity of said otoplastic shell, so that the module can be fixed in the otoplastic shell.

6. An apparatus according to claim 1, wherein the cover is a cerumen cover having sieve-like openings as a cerumen trap.

7. An apparatus according to claim 1, wherein the holes for the pins pass through an end face of the cover.

8. An apparatus according to claim 1, wherein a second end of said rotary shaft has a polygonal screw pin for screwing an adapter for an ear button to the screw neck of the hearing aid instead of the cover.

* * * * *